US008096062B1

(12) United States Patent
Bellen

(10) Patent No.: US 8,096,062 B1
(45) Date of Patent: Jan. 17, 2012

(54) TOWEL DRYING SYSTEM

(76) Inventor: Mark L. Bellen, Hoffman Estates, IL (US)

( * ) Notice: Subject to any disclaimer, the term of this patent is extended or adjusted under 35 U.S.C. 154(b) by 649 days.

(21) Appl. No.: 12/247,332

(22) Filed: Oct. 8, 2008

(51) Int. Cl.
*F26B 19/00* (2006.01)

(52) U.S. Cl. ..... 34/90; 105/202; 105/239; 392/382; 68/5 R; 68/19

(58) Field of Classification Search ..... 34/60, 80, 34/90, 105, 201, 202, 239, 242; 392/382, 392/384; 68/5 R, 19
See application file for complete search history.

(56) References Cited

U.S. PATENT DOCUMENTS

| | | | | | |
|---|---|---|---|---|---|
| 2,221,351 | A | | 11/1940 | Kempf | |
| 2,311,148 | A | * | 2/1943 | Broadus | 34/71 |
| 2,328,129 | A | * | 8/1943 | Earle | 34/90 |
| 2,349,541 | A | * | 5/1944 | Earle | 126/299 R |
| 2,539,613 | A | * | 1/1951 | Earle | 62/258 |
| 2,595,242 | A | * | 5/1952 | Goodin | 34/69 |
| 2,610,608 | A | * | 9/1952 | Graves | 119/14.03 |
| 2,675,459 | A | * | 4/1954 | Pace | 392/379 |
| 2,708,350 | A | * | 5/1955 | Earle | 62/277 |
| 2,748,413 | A | * | 6/1956 | Morrow | 15/218 |
| 2,798,367 | A | * | 7/1957 | Earle | 62/382 |
| 2,864,750 | A | * | 12/1958 | Leisle et al. | 205/737 |
| 3,078,591 | A | * | 2/1963 | Carpenter | 15/21.2 |
| 3,112,984 | A | * | 12/1963 | Aldridge | 8/115.62 |
| 3,128,161 | A | * | 4/1964 | Hudon et al. | 34/233 |
| 3,305,938 | A | * | 2/1967 | Goldstein | 34/546 |
| 3,323,279 | A | * | 6/1967 | Matsui | 53/520 |
| 3,521,638 | A | * | 7/1970 | Parrish | 604/364 |
| 3,526,106 | A | * | 9/1970 | Kennedy et al. | 68/13 R |
| 3,554,166 | A | * | 1/1971 | Belden | 119/670 |
| 3,568,668 | A | * | 3/1971 | Neis | 601/156 |
| 3,600,350 | A | * | 8/1971 | Yartz | 524/211 |
| 3,600,602 | A | * | 8/1971 | Yartz | 307/141.8 |
| 3,616,175 | A | * | 10/1971 | Jung | 442/414 |
| 3,703,884 | A | * | 11/1972 | Maddalena et al. | 119/520 |
| 3,983,079 | A | * | 9/1976 | Spadini et al. | 510/237 |
| 4,068,326 | A | * | 1/1978 | Deschler | 4/541.3 |
| 4,122,041 | A | * | 10/1978 | Mahler | 502/405 |
| 4,155,870 | A | * | 5/1979 | Jorgensen | 510/139 |
| 4,207,643 | A | * | 6/1980 | Beer et al. | 15/97.3 |
| 4,242,808 | A | * | 1/1981 | Luthi | 34/459 |
| 4,260,875 | A | * | 4/1981 | Walter et al. | 392/385 |
| 4,312,888 | A | * | 1/1982 | Klemarczyk et al. | 426/3 |
| 4,319,036 | A | * | 3/1982 | Klemarczyk et al. | 560/120 |
| 4,324,912 | A | * | 4/1982 | Klemarczyk et al. | 564/188 |
| 4,329,373 | A | * | 5/1982 | Klemarczyk et al. | 426/538 |
| 4,331,550 | A | * | 5/1982 | Klemarczyk et al. | 510/105 |
| 4,331,570 | A | * | 5/1982 | Klemarczyk et al. | 512/17 |

(Continued)

FOREIGN PATENT DOCUMENTS

DE 3918688 A1 * 12/1990

(Continued)

*Primary Examiner* — Stephen M. Gravini

(57) ABSTRACT

A towel drying system includes a housing that has a bottom wall, a top wall, a back wall, a front wall, a first lateral wall and a second lateral wall. The front wall has a primary air inlet extending therethrough and a primary air outlet extending therethrough. A blower is mounted in the housing and pulls air into the housing through primary air inlet and directs it outwardly through the primary air outlet. A towel support member is positioned in the housing. The front wall has at least one access door to access an interior of the housing and the towel support member. One or more towels may be placed on the towel support member. A dwelling return duct is fluidly coupled to the primary air outlet.

8 Claims, 8 Drawing Sheets

U.S. PATENT DOCUMENTS

| | | | | |
|---|---|---|---|---|
| 4,347,855 | A * | 9/1982 | Lanzillotti et al. | 131/78 |
| 4,347,858 | A * | 9/1982 | Klemarczyk et al. | 131/276 |
| 4,357,246 | A * | 11/1982 | Klemarczyk et al. | 510/105 |
| 4,357,253 | A * | 11/1982 | Klemarczyk et al. | 510/105 |
| 4,357,949 | A * | 11/1982 | Klemarczyk et al. | 131/276 |
| 4,374,054 | A * | 2/1983 | Klemarczyk et al. | 512/17 |
| 4,391,285 | A * | 7/1983 | Burnett et al. | 131/364 |
| 4,439,242 | A * | 3/1984 | Hadden | 134/25.2 |
| 4,464,291 | A * | 8/1984 | Sprecker et al. | 510/105 |
| 4,498,996 | A * | 2/1985 | Klemarczyk | 510/107 |
| 4,756,094 | A * | 7/1988 | Houck, Jr. | 34/225 |
| 4,780,595 | A * | 10/1988 | Alban | 392/381 |
| 4,785,162 | A * | 11/1988 | Kuo | 392/381 |
| 4,788,337 | A * | 11/1988 | Sprecker | 568/376 |
| 4,794,225 | A * | 12/1988 | Maese | 392/385 |
| 4,795,836 | A * | 1/1989 | Sprecker | 568/356 |
| 4,806,522 | A * | 2/1989 | Sprecker | 512/23 |
| 5,023,126 | A * | 6/1991 | Stevens et al. | 428/126 |
| 5,031,258 | A * | 7/1991 | Shaw | 4/623 |
| 5,068,132 | A * | 11/1991 | Brunken et al. | 427/421.1 |
| 5,079,308 | A * | 1/1992 | Harris et al. | 525/434 |
| 5,082,636 | A * | 1/1992 | Andersen | 422/294 |
| 5,135,715 | A * | 8/1992 | Andersen | 422/28 |
| 5,311,616 | A * | 5/1994 | Pratt | 392/394 |
| 5,359,736 | A * | 11/1994 | Olivier | 4/448 |
| 5,360,258 | A * | 11/1994 | Alivizatos | 297/440.11 |
| 5,448,966 | A * | 9/1995 | McKinnon et al. | 119/676 |
| 5,514,346 | A * | 5/1996 | Fujita | 422/124 |
| 5,544,369 | A * | 8/1996 | Roberts | 4/599 |
| 5,548,100 | A | 8/1996 | Miller | |
| 5,569,403 | A | 10/1996 | Swanson et al. | |
| 5,625,908 | A * | 5/1997 | Shaw | 4/623 |
| 5,651,190 | A * | 7/1997 | Sanders | 34/99 |
| 5,752,326 | A * | 5/1998 | Trim | 34/267 |
| 5,756,075 | A * | 5/1998 | Meyer | 424/59 |
| 5,765,242 | A * | 6/1998 | Marciano | 4/623 |
| 5,781,942 | A * | 7/1998 | Allen et al. | 4/623 |
| 5,827,506 | A * | 10/1998 | McShane et al. | 424/59 |
| 5,873,179 | A * | 2/1999 | Gregory et al. | 34/90 |
| 5,930,912 | A * | 8/1999 | Carder | 34/90 |
| 5,972,401 | A * | 10/1999 | Kowalski | 426/314 |
| 6,005,227 | A | 12/1999 | Pappas | |
| 6,013,589 | A * | 1/2000 | DesMarais et al. | 442/370 |
| 6,017,418 | A * | 1/2000 | Oriaran et al. | 162/111 |
| 6,059,928 | A * | 5/2000 | Van Luu et al. | 162/111 |
| 6,065,245 | A * | 5/2000 | Seawright | 47/62 R |
| 6,175,970 | B1 * | 1/2001 | Pinciaro | 4/541.4 |
| 6,231,840 | B1 * | 5/2001 | Buck | 424/61 |
| 6,235,914 | B1 * | 5/2001 | Steiger et al. | 554/114 |
| 6,236,953 | B1 * | 5/2001 | Segal | 702/127 |
| 6,468,508 | B1 * | 10/2002 | Laughlin | 424/59 |
| 6,562,142 | B2 * | 5/2003 | Barger et al. | 134/6 |
| 6,602,493 | B2 * | 8/2003 | Akhter et al. | 424/70.1 |
| 6,615,643 | B2 * | 9/2003 | James et al. | 73/73 |
| D486,210 | S | 2/2004 | Castro et al. | |
| 6,699,667 | B2 * | 3/2004 | Keen | 435/6 |
| 6,718,650 | B2 * | 4/2004 | Ross | 34/90 |
| 6,774,343 | B2 | 8/2004 | Ibanez | |
| 6,781,030 | B1 * | 8/2004 | Baguisi et al. | 800/24 |
| 6,799,381 | B1 * | 10/2004 | Cammisano | 34/397 |
| 6,817,230 | B2 * | 11/2004 | James et al. | 73/73 |
| 6,829,841 | B1 * | 12/2004 | Edwards | 34/233 |
| 6,840,589 | B2 * | 1/2005 | Uri | 312/228.1 |
| 6,846,512 | B2 * | 1/2005 | Rohrbaugh et al. | 427/201 |
| 6,892,739 | B2 * | 5/2005 | Merz et al. | 134/25.2 |
| 6,932,910 | B2 * | 8/2005 | Miller | 210/743 |
| 6,979,544 | B2 * | 12/2005 | Keen | 435/6 |
| 7,045,153 | B2 * | 5/2006 | Howarth et al. | 424/723 |
| 7,060,189 | B2 * | 6/2006 | Miller | 210/743 |
| 7,076,887 | B1 * | 7/2006 | Camberos | 34/90 |
| 7,080,668 | B2 * | 7/2006 | Fleischman et al. | 141/2 |
| 7,086,178 | B2 * | 8/2006 | Cammisano | 34/397 |
| 7,175,758 | B2 * | 2/2007 | Miller | 210/97 |
| 7,192,545 | B2 * | 3/2007 | Ekart et al. | 264/211.13 |
| 7,220,550 | B2 * | 5/2007 | Keen | 435/6 |
| 7,267,728 | B2 * | 9/2007 | Barger et al. | 134/26 |
| 7,329,723 | B2 * | 2/2008 | Jernigan et al. | 528/480 |
| 7,355,148 | B2 * | 4/2008 | Boussier | 219/544 |
| 7,381,279 | B2 * | 6/2008 | Barger et al. | 134/10 |
| 7,455,859 | B2 * | 11/2008 | Howarth et al. | 424/661 |
| 7,569,037 | B1 * | 8/2009 | Spivak | 604/289 |
| 7,592,503 | B2 * | 9/2009 | Baguisi et al. | 800/24 |
| 7,674,877 | B2 * | 3/2010 | Jernigan et al. | 528/480 |
| 7,731,760 | B2 * | 6/2010 | Cremer et al. | 8/405 |
| 7,814,595 | B2 * | 10/2010 | Kafzan | 8/151 |
| 7,828,858 | B2 * | 11/2010 | Cremer et al. | 8/405 |
| 7,842,301 | B2 * | 11/2010 | Aronson et al. | 424/401 |
| 7,914,812 | B2 * | 3/2011 | Dixon | 424/443 |
| 2001/0042693 | A1 * | 11/2001 | Onitskansky et al. | 205/780 |
| 2002/0015963 | A1 * | 2/2002 | Keen | 435/6 |
| 2002/0029490 | A1 * | 3/2002 | Lundquist | 34/90 |
| 2002/0073776 | A1 * | 6/2002 | James et al. | 73/433 |
| 2002/0084730 | A1 * | 7/2002 | Uri | 312/228.1 |
| 2002/0102359 | A1 * | 8/2002 | Rohrbaugh et al. | 427/388.4 |
| 2002/0120056 | A1 * | 8/2002 | Taylor et al. | 524/557 |
| 2002/0132214 | A1 * | 9/2002 | Mattson et al. | 434/323 |
| 2002/0144712 | A1 * | 10/2002 | Barger et al. | 134/6 |
| 2002/0160224 | A1 * | 10/2002 | Barger et al. | 428/689 |
| 2003/0034051 | A1 * | 2/2003 | Barger et al. | 134/10 |
| 2003/0049222 | A1 * | 3/2003 | Akhter et al. | 424/70.4 |
| 2003/0072778 | A1 * | 4/2003 | Aronson et al. | 424/401 |
| 2003/0181348 | A1 * | 9/2003 | Merz et al. | 510/421 |
| 2003/0213290 | A1 * | 11/2003 | James et al. | 73/73 |
| 2003/0234100 | A1 * | 12/2003 | Ross | 165/207 |
| 2004/0000067 | A1 * | 1/2004 | Baumann | 34/90 |
| 2004/0078015 | A1 * | 4/2004 | Copat et al. | 604/370 |
| 2004/0094490 | A1 * | 5/2004 | Miller | 210/805 |
| 2004/0143990 | A1 * | 7/2004 | Cammisano | 34/397 |
| 2004/0157319 | A1 * | 8/2004 | Keen | 435/287.2 |
| 2004/0159001 | A1 * | 8/2004 | Ross | 34/90 |
| 2004/0244219 | A1 * | 12/2004 | Dicke | 34/218 |
| 2004/0259754 | A1 * | 12/2004 | Gohl et al. | 510/438 |
| 2004/0262239 | A1 * | 12/2004 | Howarth et al. | 210/754 |
| 2005/0029200 | A1 * | 2/2005 | Miller | 210/743 |
| 2005/0065318 | A1 * | 3/2005 | Jernigan et al. | 528/480 |
| 2005/0086735 | A1 * | 4/2005 | Lim | 4/596 |
| 2005/0144663 | A1 * | 6/2005 | Baguisi et al. | 800/21 |
| 2005/0154183 | A1 * | 7/2005 | Ekart et al. | 528/486 |
| 2005/0191503 | A1 * | 9/2005 | Jones | 428/447 |
| 2005/0211330 | A1 * | 9/2005 | Fleischman et al. | 141/67 |
| 2006/0062834 | A1 * | 3/2006 | Dixon | 424/445 |
| 2006/0115857 | A1 * | 6/2006 | Keen | 435/7.1 |
| 2006/0188429 | A1 * | 8/2006 | Howarth et al. | 423/462 |
| 2006/0207947 | A1 * | 9/2006 | Miller | 210/743 |
| 2007/0023391 | A1 * | 2/2007 | Boussier | 216/47 |
| 2007/0028479 | A1 | 2/2007 | Hunts | |
| 2007/0082036 | A1 * | 4/2007 | Dixon | 424/445 |
| 2007/0130789 | A1 * | 6/2007 | Park et al. | 34/202 |
| 2007/0135614 | A1 * | 6/2007 | Ekart et al. | 528/272 |
| 2007/0199158 | A1 * | 8/2007 | Kafzan | 8/151 |
| 2007/0231412 | A1 * | 10/2007 | Hughes et al. | 424/683 |
| 2007/0270533 | A1 * | 11/2007 | Ekart et al. | 524/354 |
| 2008/0008865 | A1 * | 1/2008 | Luu et al. | 428/219 |
| 2008/0063774 | A1 * | 3/2008 | Aehle et al. | 426/531 |
| 2008/0104856 | A1 * | 5/2008 | Armstrong | 34/60 |
| 2008/0154021 | A1 * | 6/2008 | Jernigan et al. | 528/480 |
| 2008/0184618 | A1 * | 8/2008 | Darlington et al. | 44/443 |
| 2008/0223846 | A1 * | 9/2008 | Akel | 219/441 |
| 2009/0022485 | A1 * | 1/2009 | Madden | 392/380 |
| 2009/0100610 | A1 * | 4/2009 | Cremer et al. | 8/428 |
| 2009/0126222 | A1 * | 5/2009 | Bae et al. | 34/527 |
| 2009/0151882 | A1 * | 6/2009 | Houtan | 162/109 |
| 2009/0229059 | A1 * | 9/2009 | Cremer et al. | 8/405 |
| 2010/0001097 | A1 * | 1/2010 | Spivak | 239/207 |
| 2010/0018588 | A1 * | 1/2010 | Lee et al. | 137/338 |
| 2010/0044230 | A1 * | 2/2010 | Papadimitrakopoulos et al. | 204/547 |
| 2010/0050462 | A1 * | 3/2010 | Attonito | 34/201 |
| 2010/0089184 | A1 * | 4/2010 | Helle et al. | 73/863.83 |
| 2010/0224615 | A1 * | 9/2010 | Gallo | 219/385 |
| 2010/0269996 | A1 * | 10/2010 | Grattan et al. | 162/198 |
| 2010/0272769 | A1 * | 10/2010 | Darlington et al. | 424/409 |
| 2011/0041325 | A1 * | 2/2011 | Healey et al. | 29/650 |
| 2011/0041417 | A1 * | 2/2011 | Healey et al. | 52/79.1 |
| 2011/0120879 | A1 * | 5/2011 | Buschmann | 205/339 |

FOREIGN PATENT DOCUMENTS

| | | | | |
|---|---|---|---|---|
| DE | 19825345 | A1 | * | 3/1999 |
| DE | 19826816 | A1 | * | 12/1999 |
| DE | 19941493 | A1 | * | 3/2001 |
| EP | 360086 | A1 | * | 3/1990 |
| EP | 462883 | A1 | * | 12/1991 |
| EP | 523342 | A1 | * | 1/1993 |
| EP | 568464 | A1 | * | 11/1993 |
| EP | 787956 | A2 | * | 8/1997 |
| EP | 1030130 | A1 | * | 8/2000 |
| EP | 1077351 | A1 | * | 2/2001 |
| EP | 1287859 | A1 | * | 3/2003 |
| FR | 2656068 | A1 | * | 6/1991 |
| FR | 2659545 | A1 | * | 9/1991 |
| FR | 2772584 | A1 | * | 6/1999 |
| FR | 2784886 | A1 | * | 4/2000 |
| FR | 2836717 | A1 | * | 9/2003 |
| GB | 2389308 | A | * | 12/2003 |
| JP | 2003047572 | A | * | 2/2003 |
| WO | WO 9115145 | A1 | * | 10/1991 |
| WO | WO 03/035528 | A1 | * | 5/2003 |

* cited by examiner

TOWEL DRYING SYSTEM

BACKGROUND OF THE INVENTION

Field of the Invention

The present invention relates to towel drying devices and more particularly pertains to a new towel drying device for drying and warming a towel in between and before uses.

SUMMARY OF THE INVENTION

The present invention meets the needs presented above by generally comprising a housing that has a bottom wall, a top wall, a back wall, a front wall, a first lateral wall and a second lateral wall. The front wall has a primary air inlet extending therethrough and a primary air outlet extending therethrough. A blower is mounted in the housing and pulls air into the housing through primary air inlet and directs it outwardly through the primary air outlet. A towel support member is positioned in the housing. The front wall has at least one access door to access an interior of the housing and the towel support member. One or more towels may be placed on the towel support member. A dwelling return duct is fluidly coupled to the primary air outlet.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
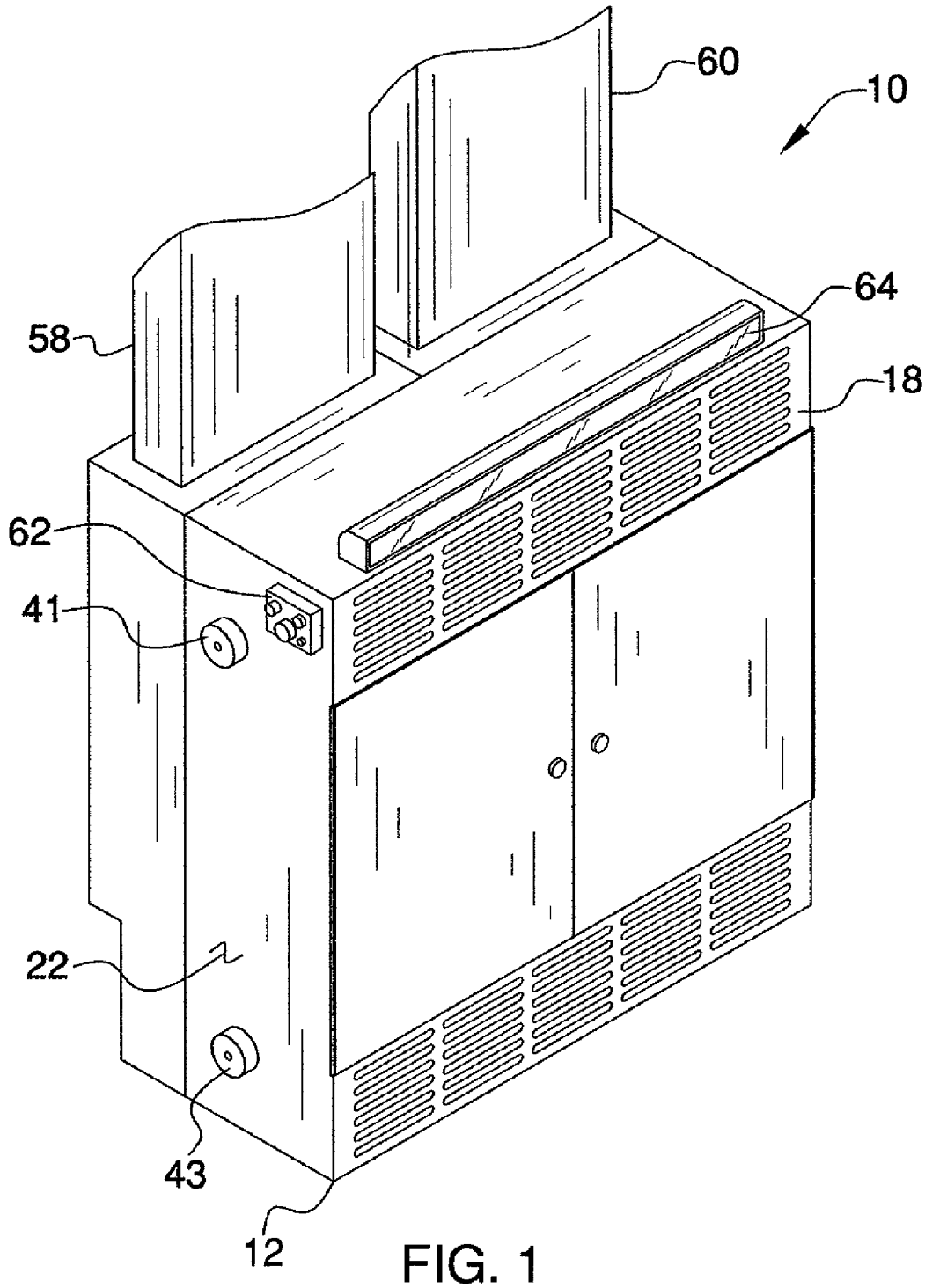
FIG. 1 is a front perspective view of a towel drying system according to the present invention.
Figure 2:
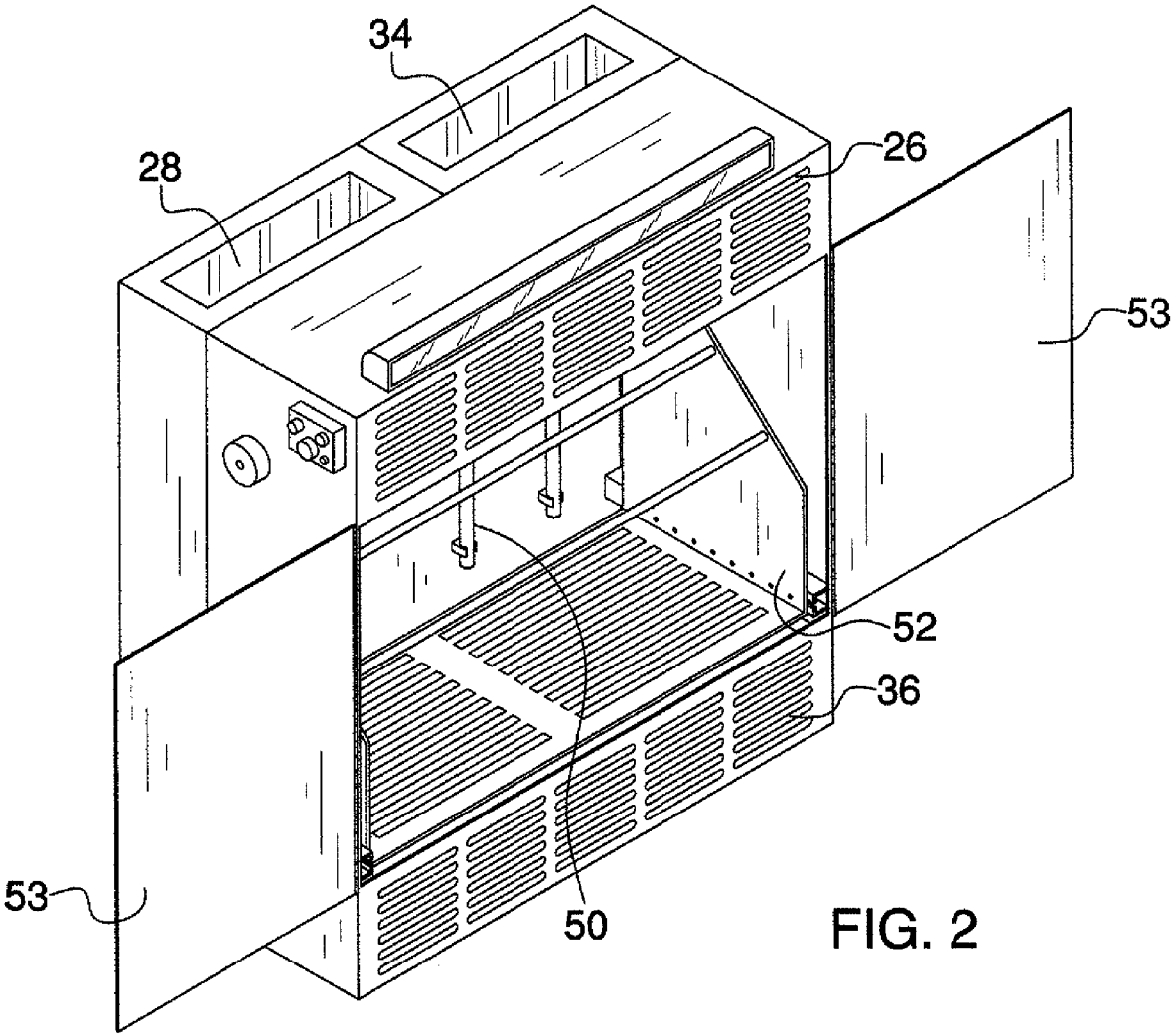
FIG. 2 is a front perspective view of the present invention.
Figure 3:
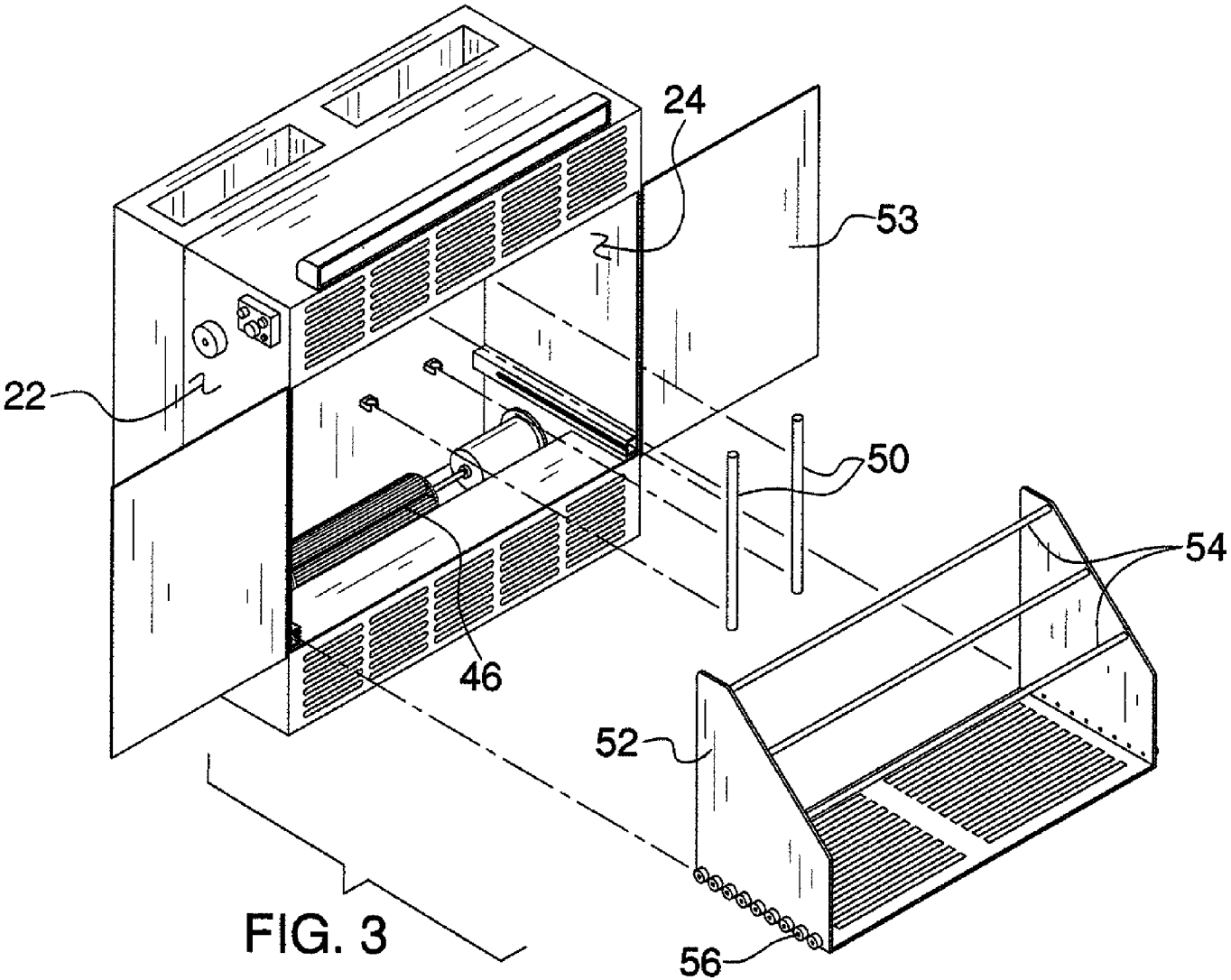
FIG. 3 is an expanded front perspective view of the present invention.
Figure 4:
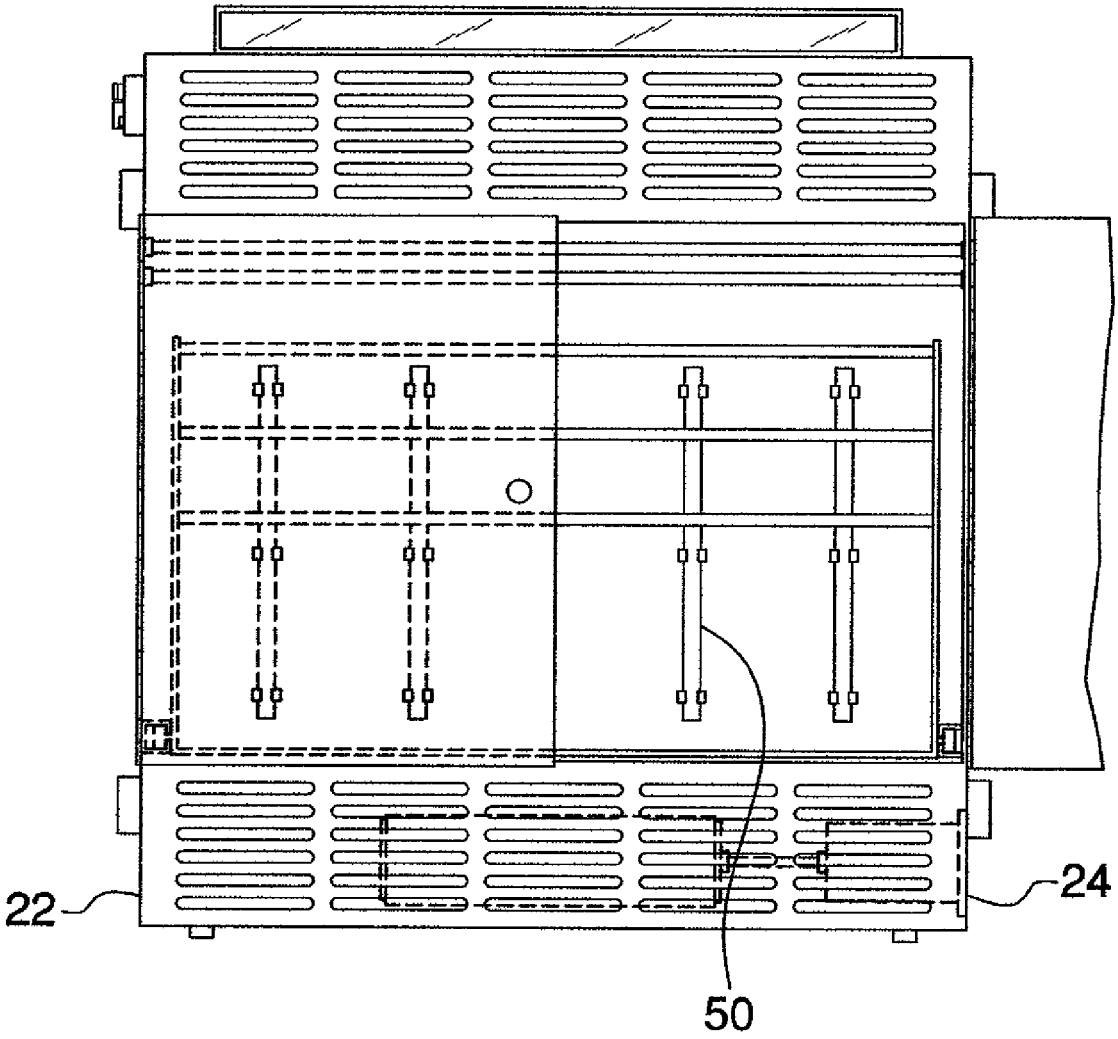
FIG. 4 is a front view of the present invention.
Figure 5:
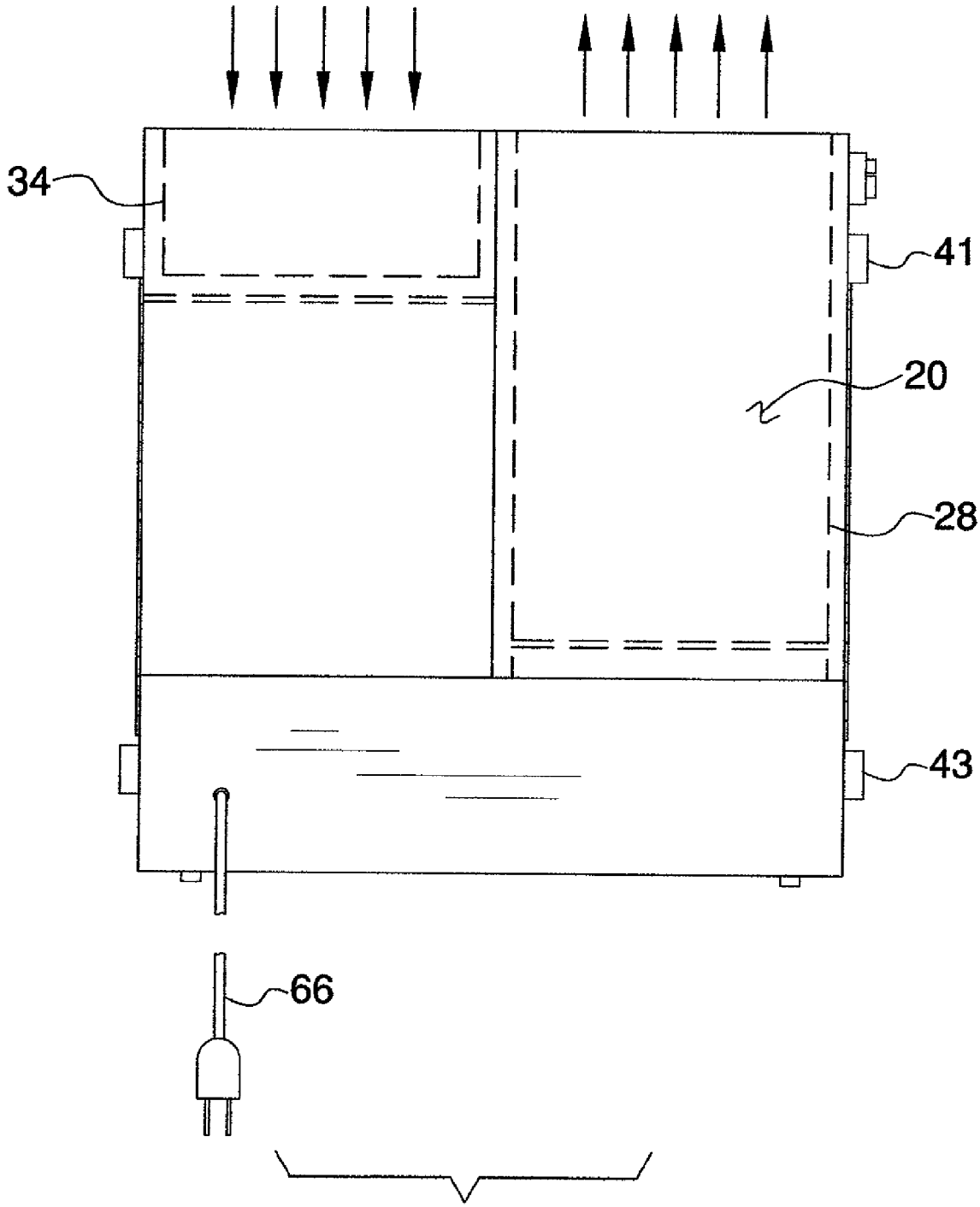
FIG. 5 is a rear view of the present invention.
Figure 6:
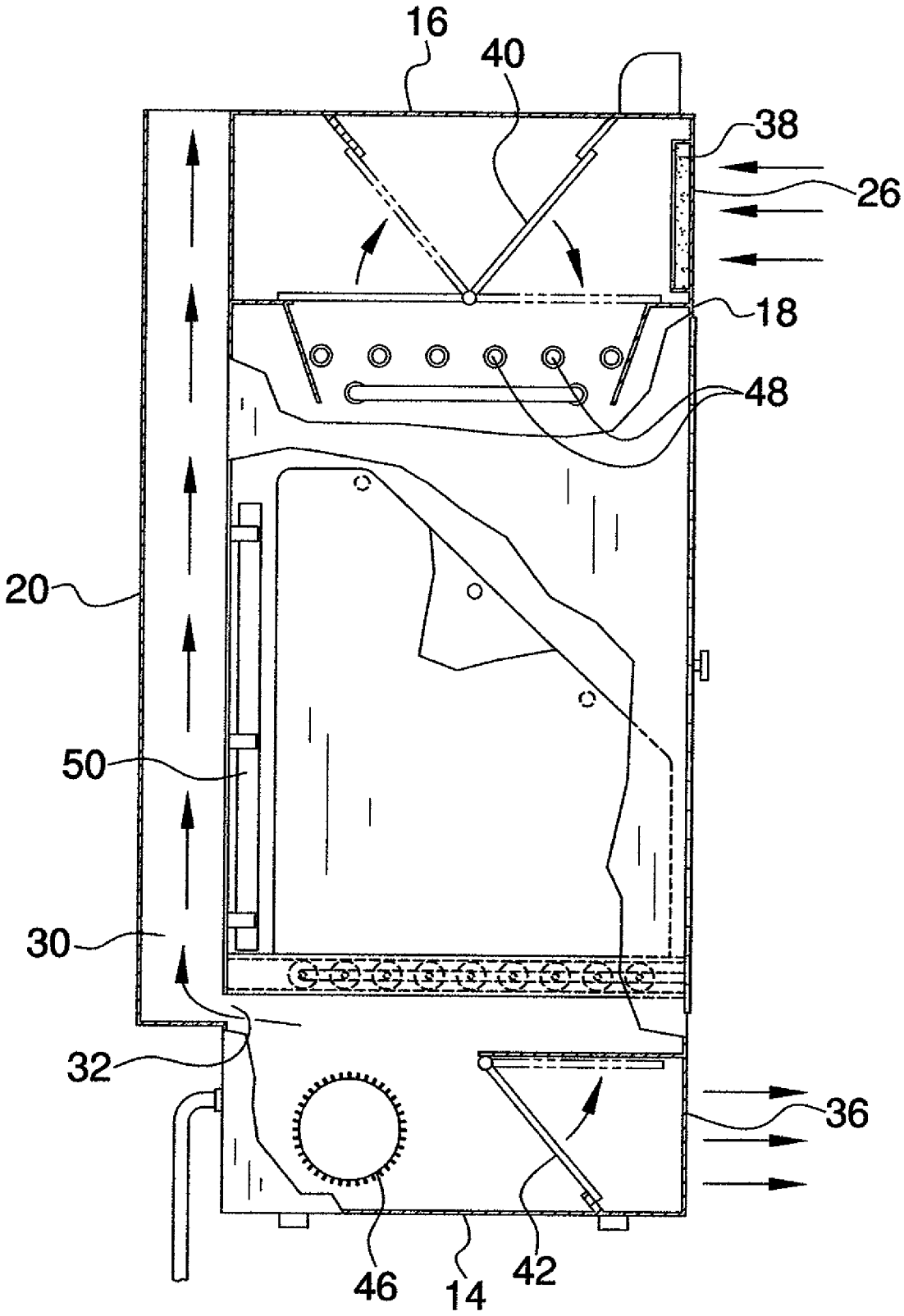
FIG. 6 is a side broken view of the present invention.
Figure 7:
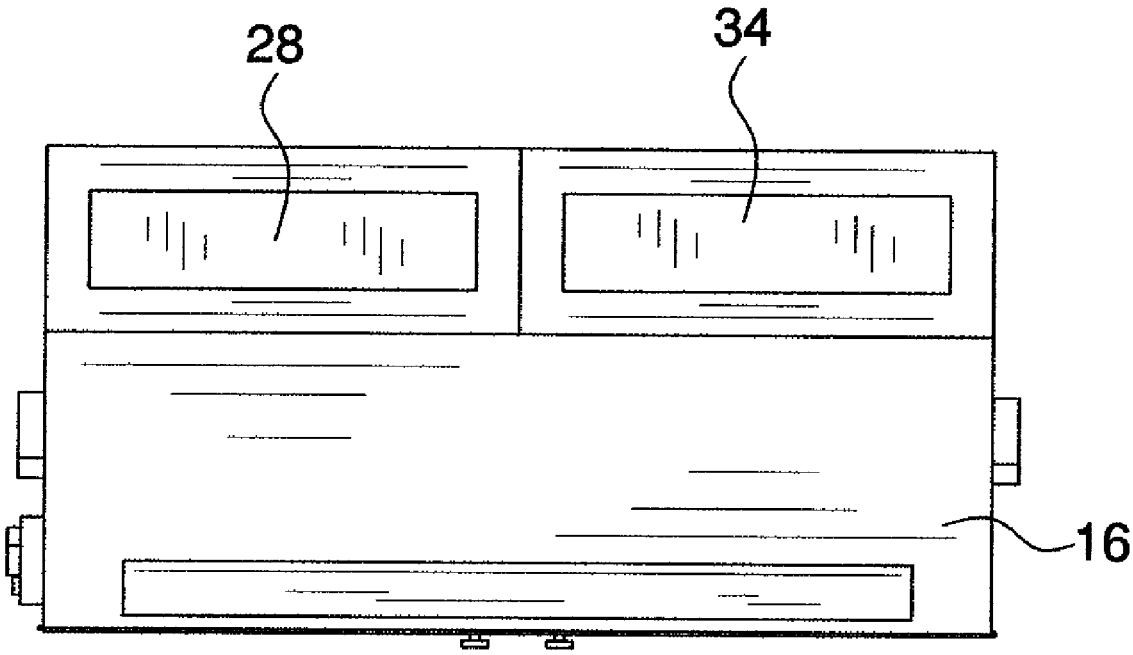
FIG. 7 is a top view of the present invention.
Figure 8:
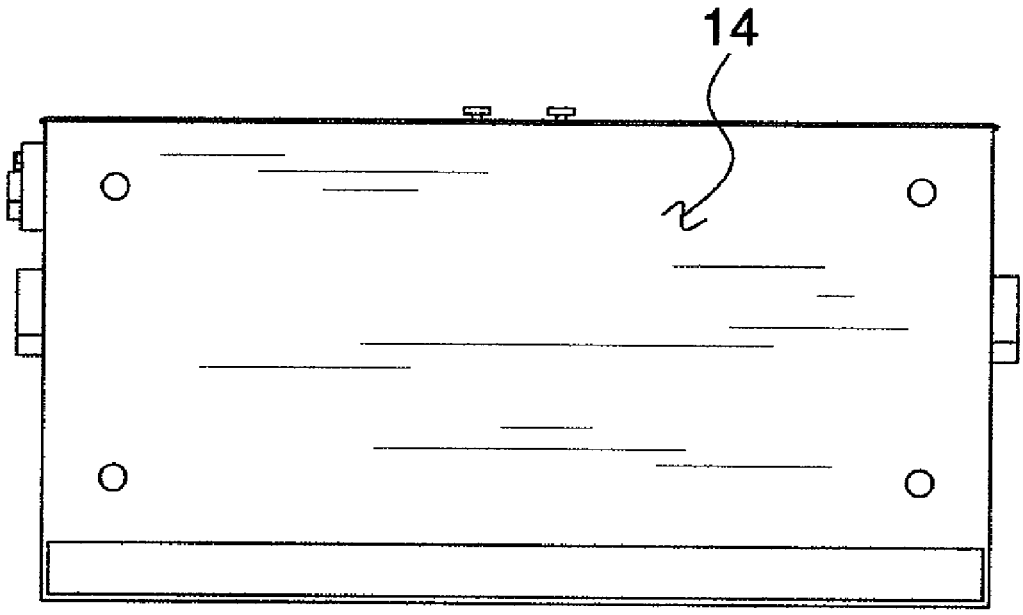
FIG. 8 is a bottom view of the present invention.
Figure 9:
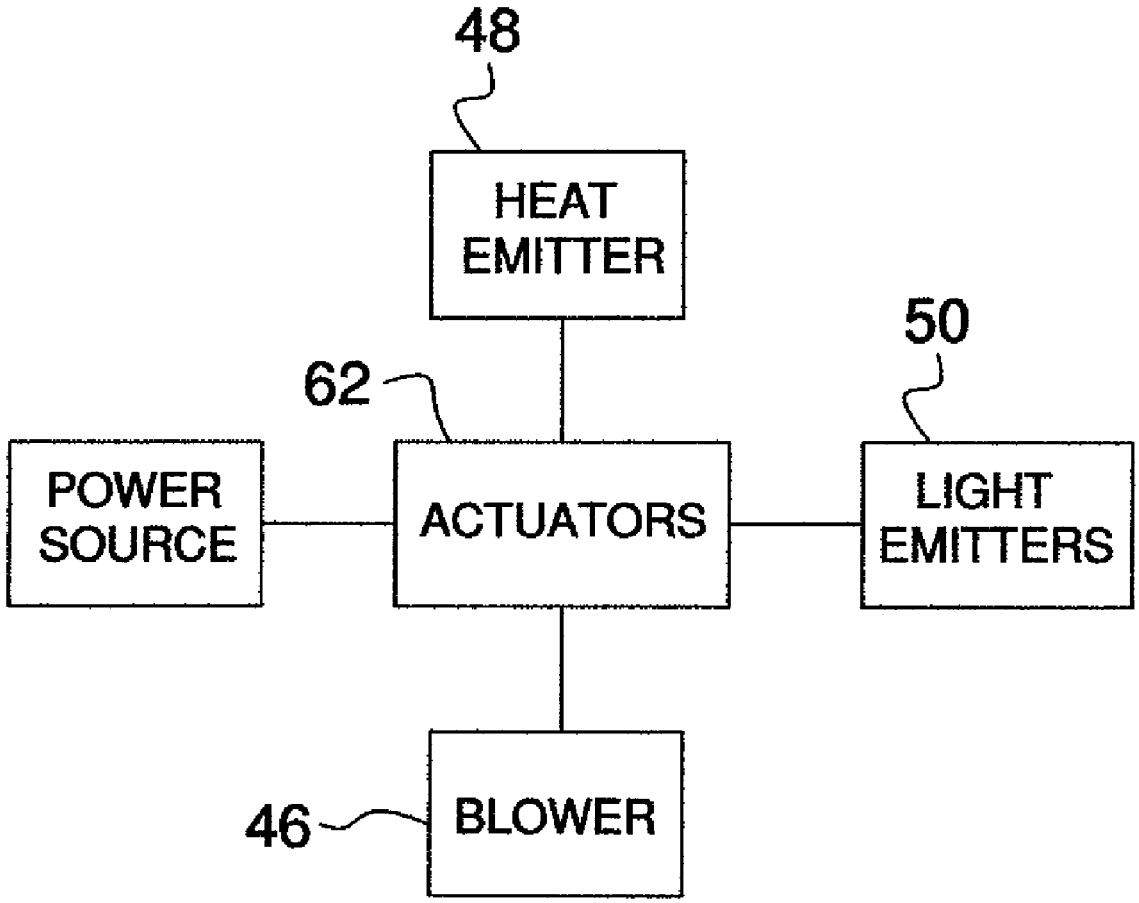
FIG. 9 is a schematic view of the present invention.

With reference now to the drawings, and in particular to FIGS. 1 through 9 thereof, a new towel drying device embodying the principles and concepts of the present invention and generally designated by the reference numeral 10 will be described.

As best illustrated in FIGS. 1 through 9, the towel drying system 10 generally comprises a housing 12 that has a bottom wall 14, a top wall 16, a back wall 18, a front wall 20, a first lateral wall 22 and a second lateral wall 24. The front wall 20 has a primary air inlet 26 extending therethrough. The housing 12 has a primary air outlet 28 extending therethrough. An air conduit 30 is fluidly coupled to the primary air outlet 28. The air conduit 30 has an access opening 32 positioned distal to the primary air outlet 26 within the housing 12. The housing 12 has a secondary inlet 34 therein. The front wall 20 has a secondary outlet 36 extending therethrough. An air filter 38 is positioned over the primary air inlet 26. The air filter 38 prevents dust from entering the housing 12.

An inlet baffle 40 is mounted within the housing 12. The inlet baffle 40 is positionable in a first position opening the primary inlet 26 and closing the secondary inlet 34. The inlet baffle 40 is positionable in a second position closing the primary inlet 26 and opening the secondary inlet 34. An outlet baffle 42 is mounted within the housing. The outlet baffle 42 selectively opens or closes the secondary air outlet 36. An inlet baffle knob 41 controls the inlet baffle 40 and an outlet baffle knob 43 control the outlet baffle 42.

A blower 46 is mounted in the housing 12 and pulls air into the housing 12 through the primary 26 or secondary 34 air inlets and directs it outwardly through the primary air outlet 28 or the primary 28 and secondary 36 air outlets. A heat emitting member 48 is mounted in the housing 12 and is positioned nearer to the primary air inlet 26 than the primary air outlet 28. The heat emitting member 48 warms air traveling through the housing 12 when the heat emitting member 48 is turned on. The heat emitting member 48 comprises one or more heat elements. A plurality of ultraviolet light emitters 50 is mounted in the housing 12. The ultraviolet light emitters 50 emit light when turned on to prevent microbial growth.

A towel support member 52 is positioned in the housing 12. The front wall 18 has at least one access door 53 to access an interior of the housing 12 and the towel support member 52. One or more towels may be placed on the towel support member 52. The towel support member 52 comprises a removable rack having a plurality of elongated rods 54 thereon. Wheels 56 positioned on the tower support member 52 allows for easier removal of the towel support member 52 from the housing 12.

A dwelling return duct 58 is fluidly coupled to the primary air outlet 28. The dwelling return duct 58 allows air, from the room the housing 12 is positioned in, to be removed and vented. A dwelling air supply duct 60 is fluidly coupled to the secondary air inlet 34. The dwelling air supply duct 60 provides fresh air to the housing 12.

The system 10 includes a plurality of actuators 62 mechanically coupled to heat emitter 48, blower 46 and ultraviolet light emitters 50 to turn on each as needed. An emergency light 64, powered by a battery, may be mounted on the housing 12 and turned on to emit light when power to the housing 12 is cut off. An electrical cord 66 is electrically coupled to the system 10 and pluggable into a female electrical outlet to power the system 10.

In use, the back wall 20 of the housing 12 is mounted within a dwelling wall so that it may be fluidly coupled to the air supply 58 and return 60 ducts. Towels are positionable in the housing 12 and blower 46 turned on to draw air into the housing 12 to dry the towels. The secondary air outlet 34 may be used to provide warmed air to the room while the secondary air inlet 34 may be used to draw fresh air into the room. The system 10, aside from drying and disinfecting towels, will remove moist air from a room.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A towel drying system comprising:

a housing having a bottom wall, a top wall, a back wall, a front wall, a first lateral wall and a second lateral wall, said front wall having a primary air inlet extending therethrough, said housing having a primary air outlet extending therethrough;

a blower being mounted in said housing and pulling air into said housing through primary air inlet and directing it outwardly through said primary air outlet;

a towel support member being positioned in said housing, said front wall having at least one access door to access an interior of said housing and said towel support member, wherein one or more towels may be placed on said towel support member; and a dwelling return duct being fluidly coupled to said primary air outlet.

2. The system according to claim 1, further including:

said housing having a secondary inlet therein;

an inlet baffle being mounted within said housing, said inlet baffle being positionable in a first position opening said primary inlet and closing said secondary inlet, said inlet baffle being positionable in a second position closing said primary inlet and opening said secondary inlet; and a dwelling air supply duct being fluidly coupled to said secondary air inlet.

3. The system according to claim 1, further including:

said front wall having a secondary outlet extending therethrough;

an outlet baffle being mounted within said housing, said outlet baffle selectively opening or closing said secondary air outlet;

a heat emitting member being mounted in said housing and being positioned nearer to said primary air inlet than said primary air outlet, said heat emitting member warming air traveling through said housing when said heat emitting member is turned on.

4. The system according to claim 1, further including a heat emitting member being mounted in said housing and being positioned nearer to said primary air inlet than said primary air outlet, said heat emitting member warming air traveling through said housing when said heat emitting member is turned on.

5. The system according to claim 4, further including a plurality of ultraviolet light emitters being mounted in said housing, said ultraviolet light emitters emitting light when turned on to prevent microbial growth.

6. The system according to claim 1, further including a plurality of ultraviolet light emitters being mounted in said housing, said ultraviolet light emitters emitting light when turned on to prevent microbial growth.

7. The system according to claim 1, further including an air filter being positioned over said primary air inlet.

8. A towel drying system comprising:

a housing having a bottom wall, a top wall, a back wall, a front wall, a first lateral wall and a second lateral wall, said front wall having a primary air inlet extending therethrough, said housing having a primary air outlet extending therethrough, an air conduit being fluidly coupled to said primary air outlet, said air conduit having an access opening positioned distal to said air outlet within said housing, said housing having a secondary inlet therein, said front wall having a secondary outlet extending therethrough;

an inlet baffle being mounted within said housing, said inlet baffle being positionable in a first position opening said primary inlet and closing said secondary inlet, said inlet baffle being positionable in a second position closing said primary inlet and opening said secondary inlet;

an outlet baffle being mounted within said housing, said outlet baffle selectively opening or closing said secondary air outlet;

a blower being mounted in said housing and pulling air into said housing through primary or secondary air inlets and directing it outwardly through said primary air outlet or said primary and secondary air outlets;

a heat emitting member being mounted in said housing and being positioned nearer to said primary air inlet than said primary air outlet, said heat emitting member warming air traveling through said housing when said heat emitting member is turned on;

a plurality of ultraviolet light emitters being mounted in said housing, said ultraviolet light emitters emitting light when turned on to prevent microbial growth;

a towel support member being positioned in said housing, said front wall having at least one access door to access an interior of said housing and said towel support member, wherein one or more towels may be placed on said towel support member;

an air filter being positioned over said primary air inlet;

a dwelling return duct being fluidly coupled to said primary air outlet; and a dwelling air supply duct being fluidly coupled to said secondary air inlet.

* * * * *